United States Patent [19]

Marchetti

[11] Patent Number: 4,698,950

[45] Date of Patent: Oct. 13, 1987

[54] DEVICE FOR CLOSING THE TOP SIDEFLAPS OF BOX HAVING FOLDING FLAPS

[76] Inventor: Augusto Marchetti, Piazza Sicilia, 7, 20146 Milano, Italy

[21] Appl. No.: 836,134

[22] Filed: Mar. 4, 1986

[30] Foreign Application Priority Data

Mar. 6, 1985 [IT] Italy ..... 19788 A/85

[51] Int. Cl.[4] ..... B65B 7/20

[52] U.S. Cl. ..... 53/374; 493/183; 493/438

[58] Field of Search ..... 53/374, 375, 491; 493/438, 453, 183

[56] References Cited

U.S. PATENT DOCUMENTS

| | | | |
|---|---|---|---|
| 2,962,733 | 12/1960 | Kramer et al. | 493/438 X |
| 3,288,037 | 11/1966 | Burnett | 493/453 X |
| 3,726,061 | 4/1973 | Pagdin et al. | 53/374 X |

*Primary Examiner*—James F. Coan

*Attorney, Agent, or Firm*—Cushman, Darby & Cushman

[57] ABSTRACT

A pair of helical guides has each guide made up of two integral helical portions, one outermost and the other innermost, longitudinally offset from each other. The two portions develop from respective basically parallel oblique inlet ends to respective coplanar horizontal outlet ends and are engageable by the erect side flaps of wider or narrower boxes respectively without the necessity of adjustment of the distance apart thereof.

5 Claims, 13 Drawing Figures

DEVICE FOR CLOSING THE TOP SIDEFLAPS OF BOX HAVING FOLDING FLAPS

BACKGROUND OF THE INVENTION

1. Field of the Invention

The present invention relates to a device for closing the top side flaps of a box having folding flaps, to be employed in a cardboard box closing machine.

2. Description of the Related Art

Machines are known which are capable of performing in rapid succession the closing of the top end flaps and then that of the top side flaps of a cardboard box with open top flaps before application of a sealing adhesive tape along the slit separating the side flaps folded in the closing position.

To close the side flaps the machines usually employ a device formed of a pair of helical guides which, upon meeting the side flaps, bring about their progressive movement to the closing position.

An existing problem for said device is its adaptation not only to the varying height but also to the varying width of the boxes which problem results in varying height of the flaps in their erect position.

This problem makes necessary adjustment of the distance between the two helical guides in addition to the usual regulation of height. As a result there is a loss of time each time the box width changes and hence an undesirable reduction of production rate.

SUMMARY OF THE INVENTION

The object of the present invention is to provide a device for closing the top side flaps of a box with folding flaps which would be able to operate indifferently without adjustment on boxes of differing width.

In accordance with the invention, this object is achieved by a device comprising a pair of symmetrical guides for the closure folding of the side flaps characterized in that each of the guides comprises two integral helical portions, one innermost and one outermost and offset longitudinally to each other, which develop from parallel oblique inlet ends to coplanar horizontal outlet ends in such a manner as to be respectively engageable by the erect side flaps of boxes of greater or lesser width to progressively fold the flaps into the horizontal closing position.

In this manner the closing device of the side flaps needs no adjustment of distance based on the width of the boxes, offering the outermost helical part for initial engagement with the side flaps of the wider boxes and the innermost helical part for the initial engagement of the side flaps of the narrower boxes.

At the same time, by appropriately approaching and uniting the two helical parts of each guide it is possible to limit the longitudinal development of the device and hence of the machine which includes it.

These and other characteristics of the present invention will be made clear by the detailed description given below of a practical embodiment thereof illustrated as an example in the annexed drawings.

DETAILED DESCRIPTION OF THE PREFERRED EMBODIMENT

Figure 1:
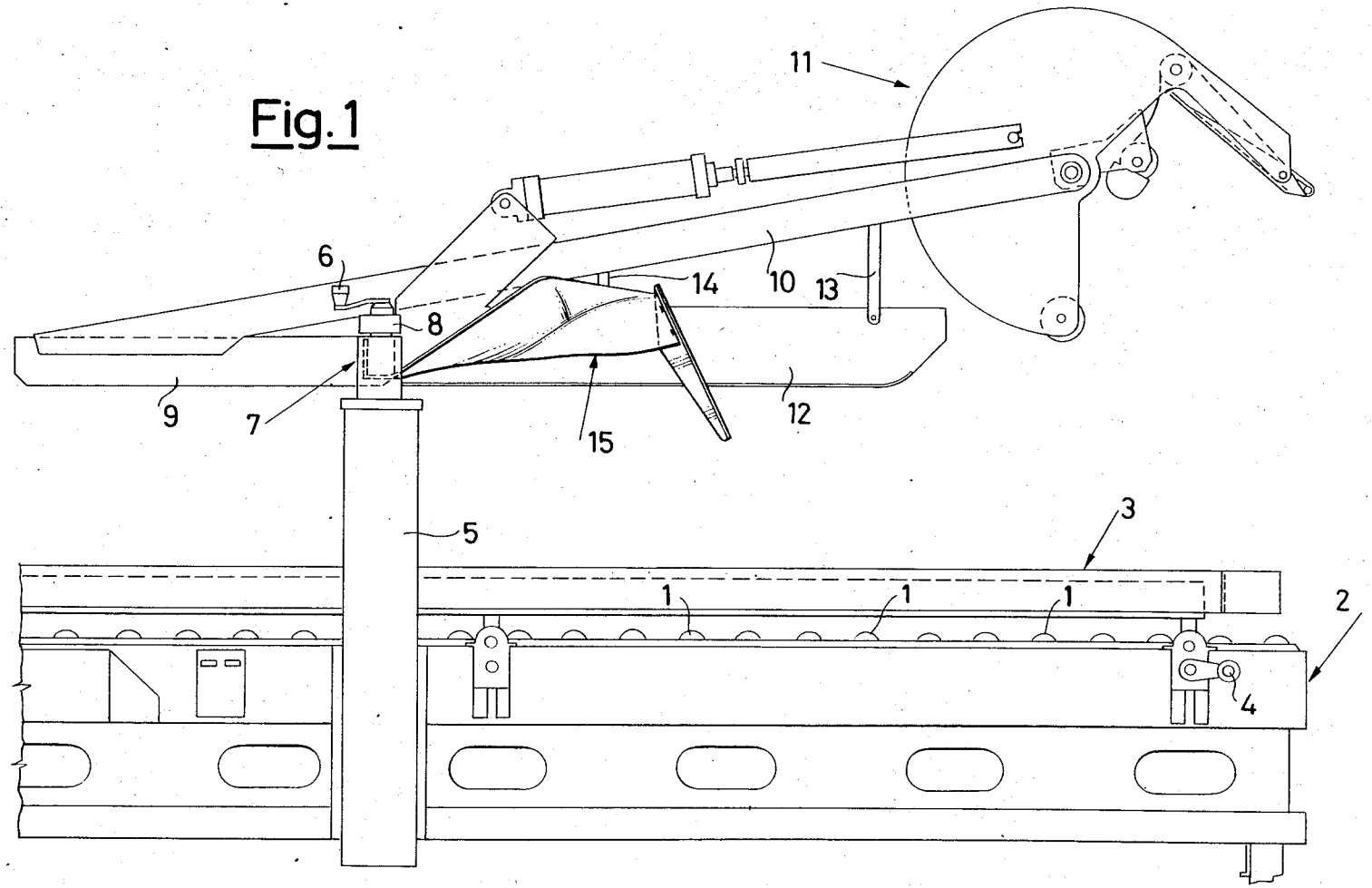
FIG. 1 shows a schematic side view of a cardboard box closing machine which includes a closing device for the side flaps in accordance with the present invention.
Figure 2:
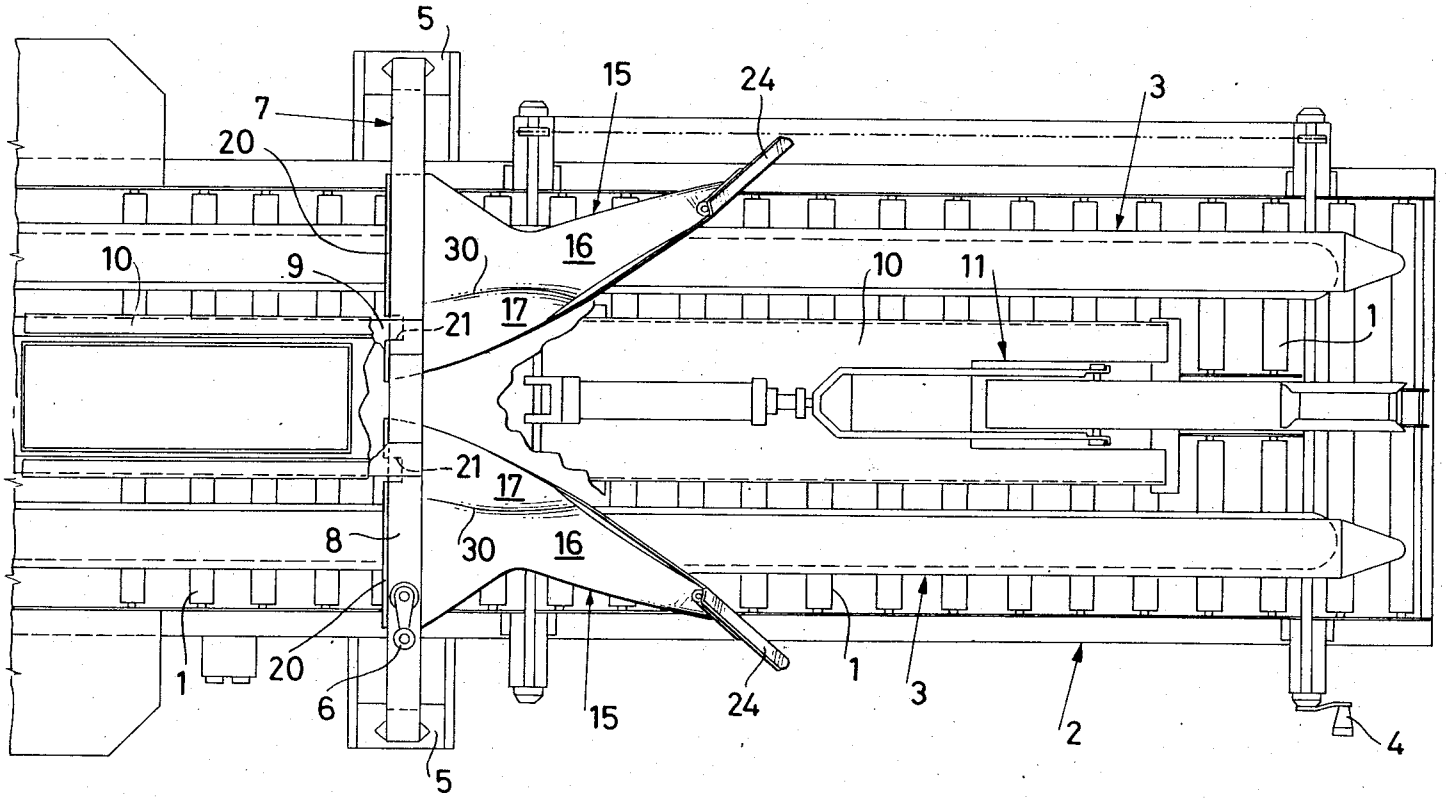
FIG. 2 shows a top view of said closing machine.
Figure 3:
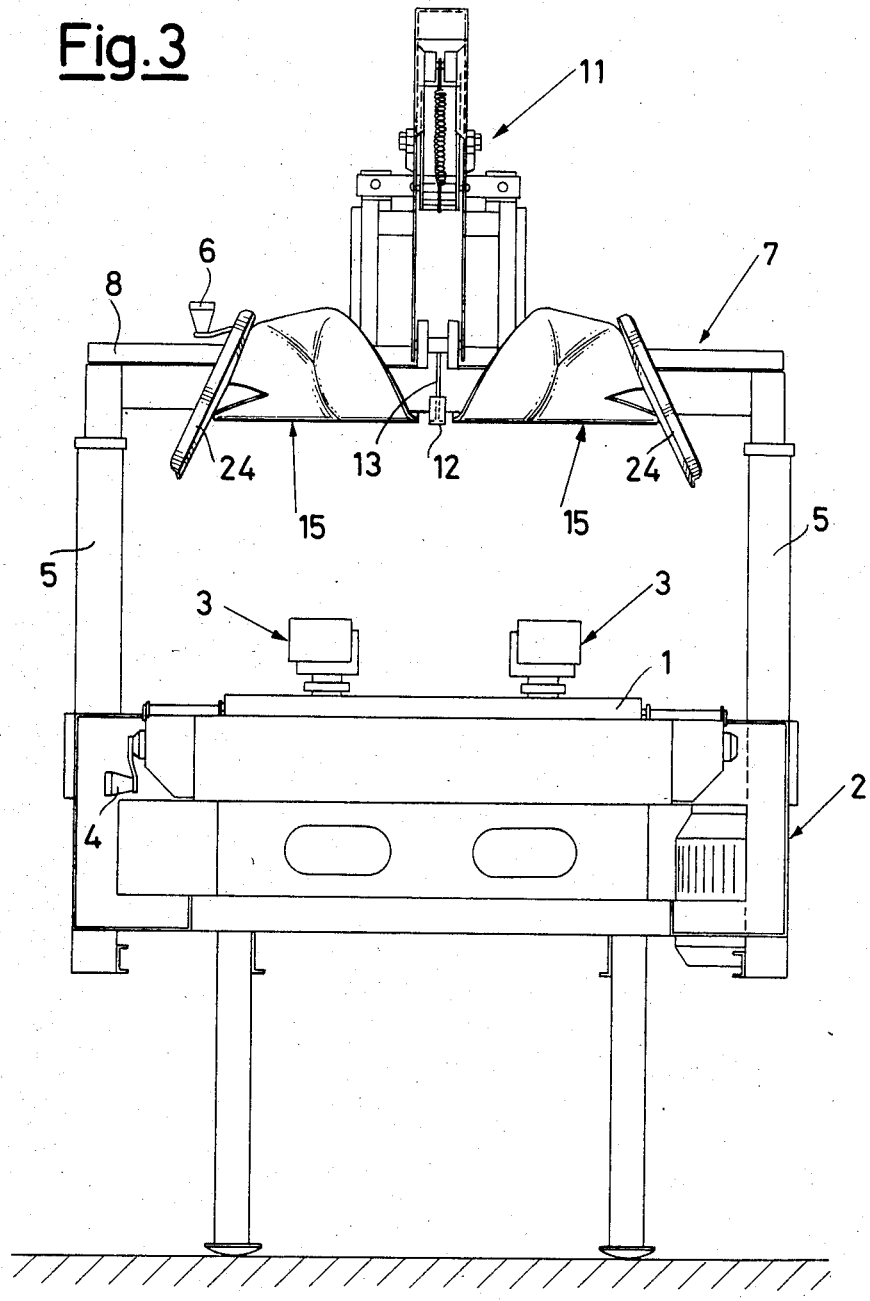
FIG. 3 shows a front view of said closing machine from the box inlet end.

The machine shown in FIGS. 1–3 comprises first of all a supporting and conveying plane for the boxes which is described by a series of idle rollers 1 supported by a bed 2. At the two sides of said supporting plane, there are arranged two belt-pulling assemblies 3 which by known means operated by a crank 4 can be placed at an adjustable distance apart such as to allow engagement thereof with the sides of the boxes to advance said boxes (from right to left when viewing FIG. 1).

Two side columns 5 support in a vertically adjustable manner (by known means operated by a crank 6) a portal structure 7 including a crosspiece 8. From the crosspiece 8, there extends in the direction of travel of the boxes a pair of horizontal arms 9 from which extends obliquely in the opposite direction a similar two armed supporting structure 10 for a closing device 11 to close the top end flaps of the boxes.

The closing device 11 is the object of a copending utility model application of the same applicant and to which reference is made for a detailed description of the structure and operation of said device 11. For the purposes of the present invention, the device 11 provides sequential closing of the front and rear flaps of each box before closing of the side flaps which is accomplished by the device according to the present invention.

In combination with the closing device 11, there operates a device for holding the end flaps in a closed position which holding device consists of an overturned T structure 12 (known in itself) that is suspended in the horizontal position from the oblique supporting structure 10 by a pair of parallel pivoted rods 13 and 14. The distance of the lower horizontal wing of the T-structure 12 from the supporting plane described by the rollers 1 establishes clearly the height of the boxes acceptable to the machine. Said distance, and hence the acceptable height, is adjustable by means of the crank 6.

Figure 4:
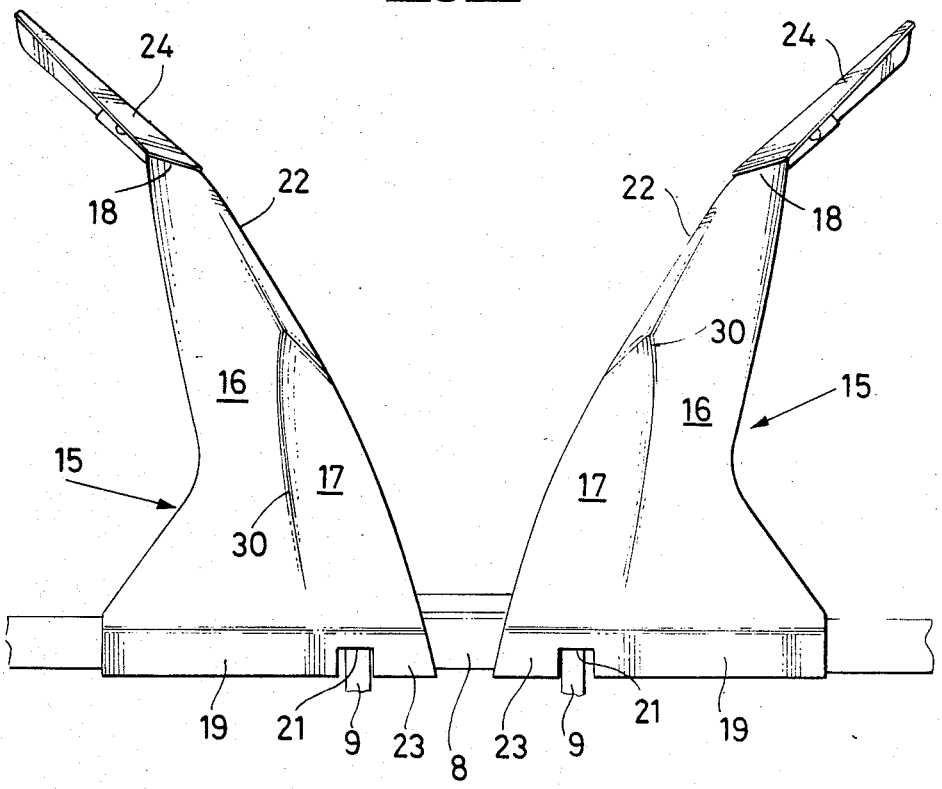
FIG. 4 shows an enlarged detailed bottom view of said closing device and of the associated supporting structure.
Figure 5:
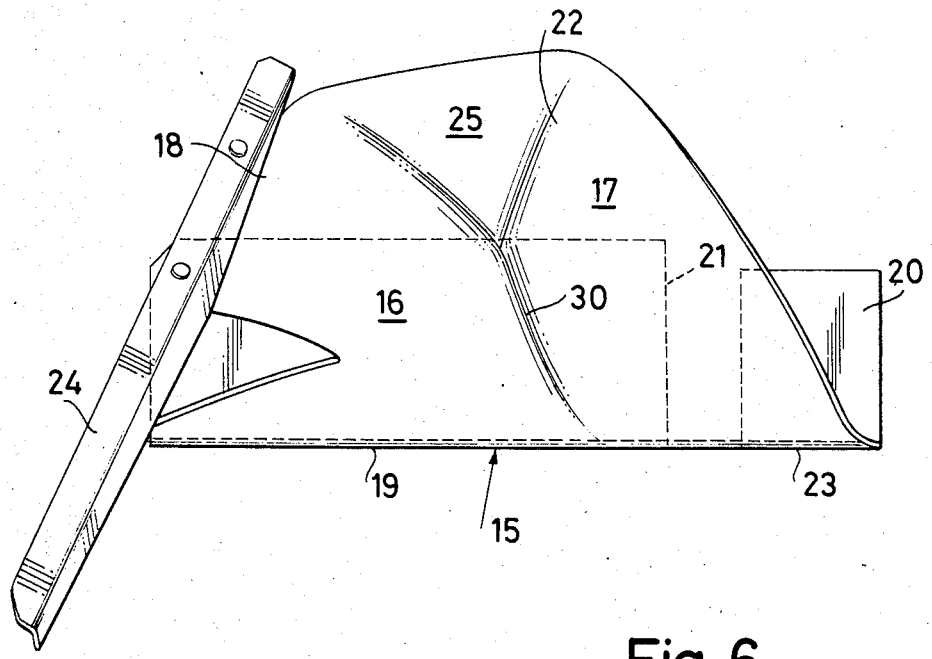
FIG. 5 shows an enlarged detailed front view of one of the two helical guides which form part of said closing device.
Figure 6:
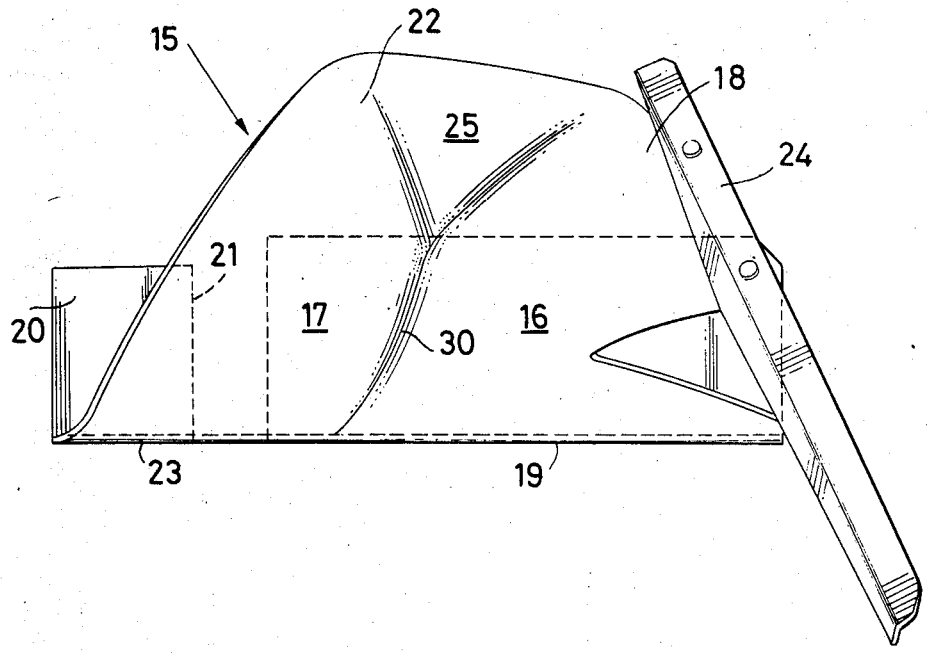
FIG. 6 shows an enlarged detailed front view of the other helical guide of said closing device.
Figure 7:
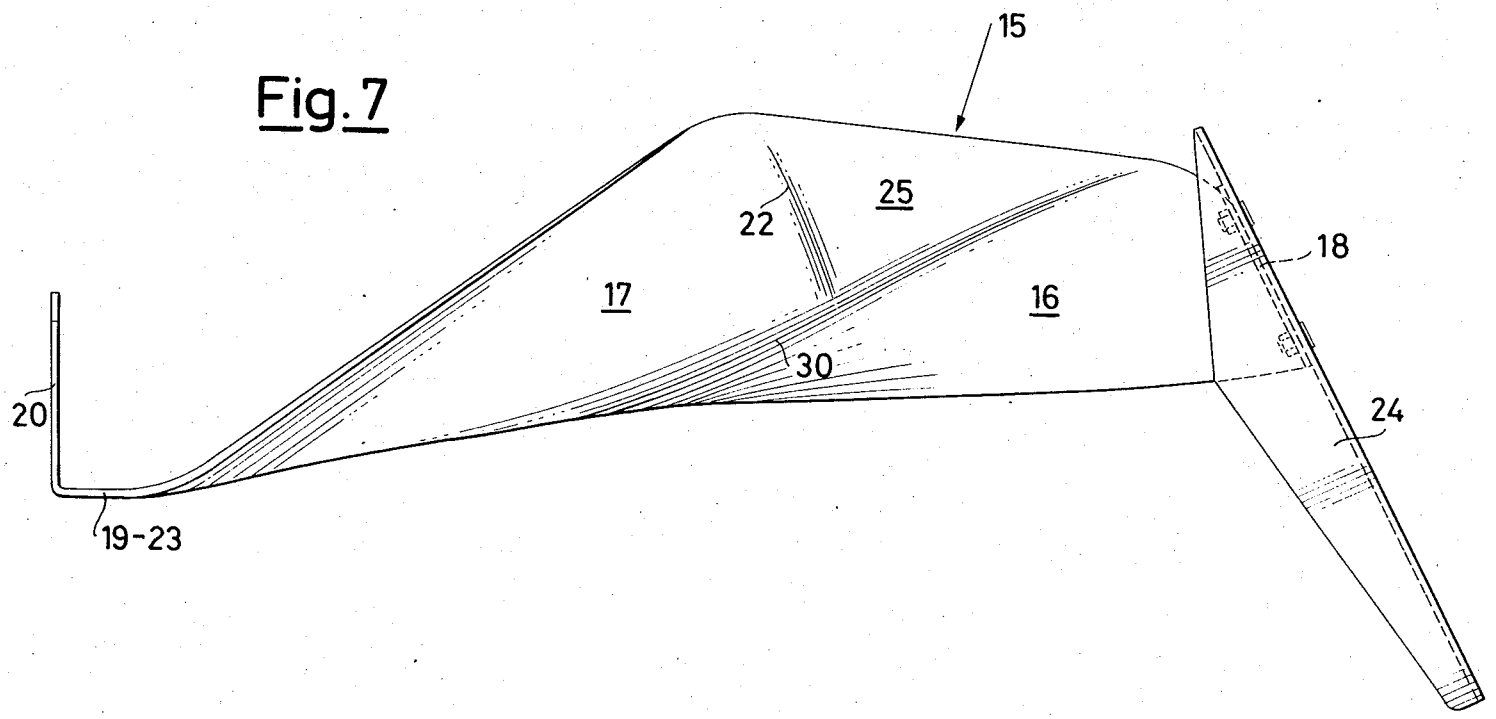
FIG. 7 shows a side view of the helical guide of FIG. 6 from the left of said figure.
Figure 8:
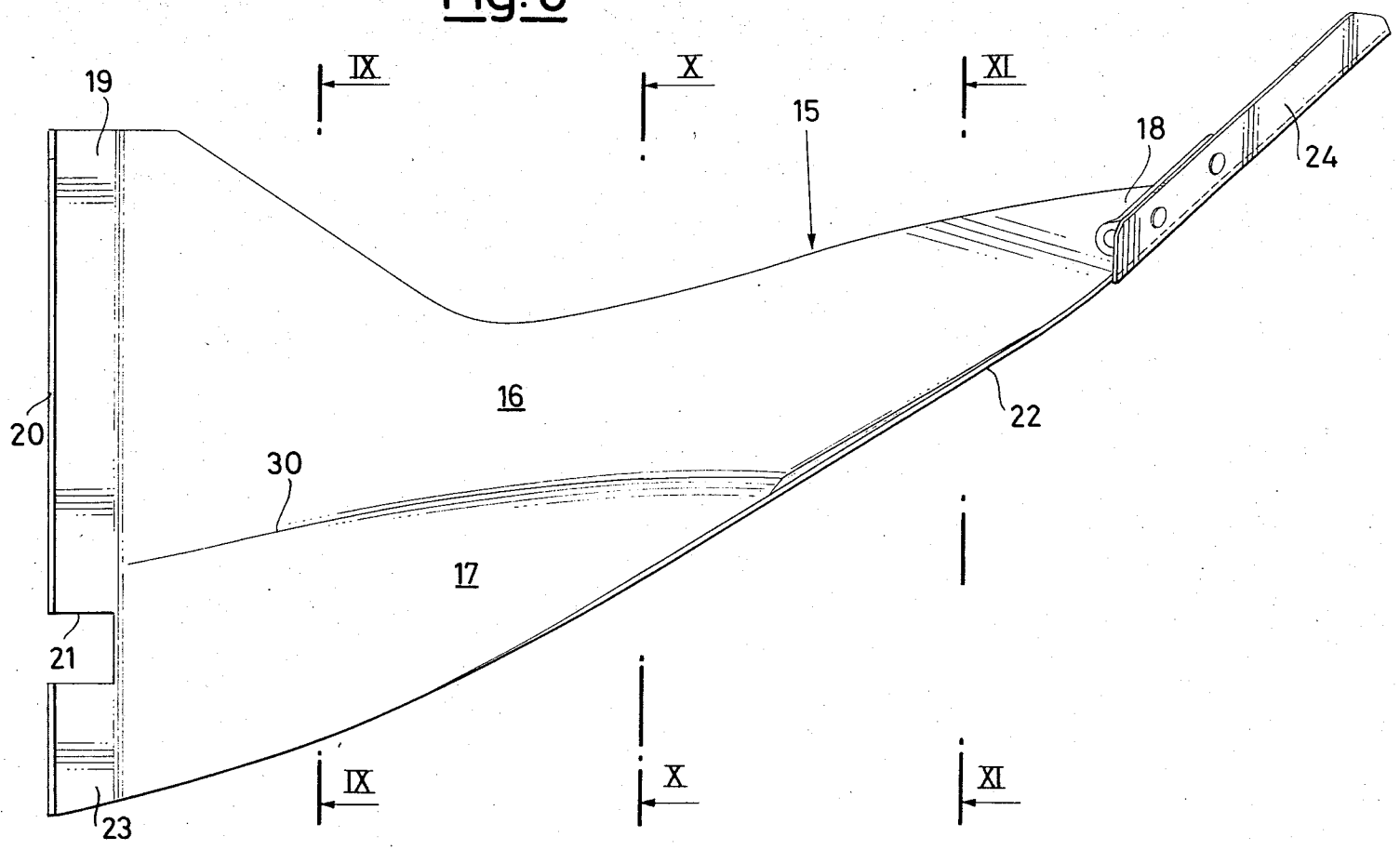
FIG. 8 shows a top view of the helical guide of FIGS. 6 and 7.
Figure 9:
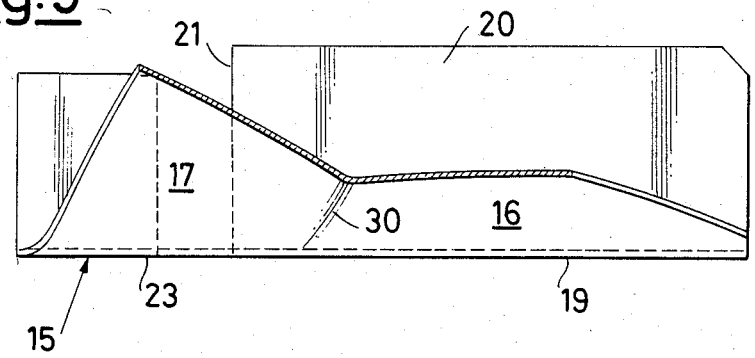
FIG. 9 shows a cross section along line IX—IX of FIG. 8 of the helical guide of FIGS. 6, 7 and 8.
Figure 10:
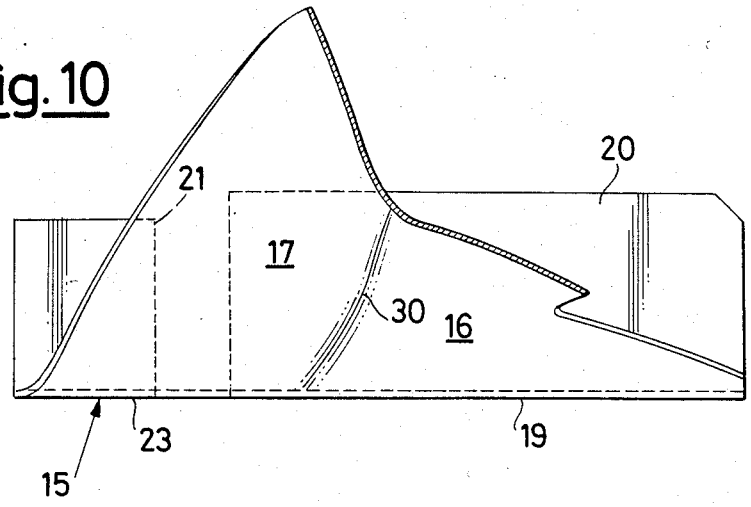
FIG. 10 shows a cross section along line X—X of FIG. 8 of the helical guide of FIGS. 6, 7 and 8.
Figure 11:
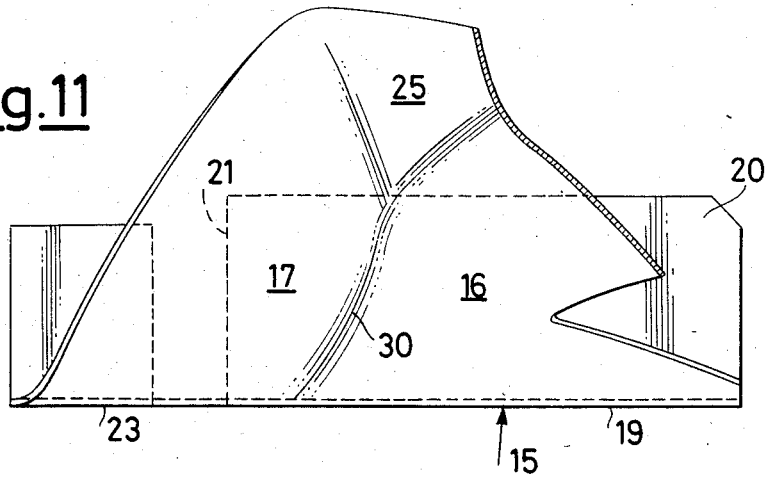
FIG. 11 shows a cross section along line XI—XI of FIG. 8 of the helical guide of FIGS. 6, 7 and 8.

To close the side flaps of the boxes there is provided as already mentioned the device in accordance with the invention which consists basically of a pair of symmetrical guides 15 fixed to the crosspiece 8 (FIGS. 2 and 4).

As better illustrated in FIGS. 4–11 each of the guides 15 consists of two flanking integral helical portions 16 and 17, the first outermost and the other innermost, which are offset longitudinally in relation to each other. The outermost portion 16 develops with an appropriately selected pitch from an oblique inlet end 18, amply shifted toward the side of the machine (FIG. 3) and fitted with reinforcing section 24, to a horizontal outlet end 19 (FIGS. 5, 6, 8 and 9) fitted with a turned-up edge 20 for securing the guide 15 to the crosspiece 8 (FIG. 1 and 4). The innermost portion 17 joined with the adjacent portion 16 along a border line 30 develops in turn with a slightly different pitch (FIGS. 9 and 10) from an oblique inlet end 22, basically parallel to the corresponding oblique inlet end 18 of the outermost portion 16 and shifted inward therefrom (FIGS. 5–8), to a horizontal outlet end 23 which is coplanar and transversally aligned with the corresponding horizontal outlet end 19 of the outermost helical portion 16 (FIGS. 5, 6 and 9) and also equipped with said turned-up edge 20 as well as a notch 21 for passage of the horizontal arm 9 (FIGS. 1 and 4). A connecting portion 25 completes the guide structure 15 in the part thereof facing to the direction of arrival of the boxes as illustrated in FIGS. 3–7 and 11.

By the effect of the described conformation of the two guides 15 in two helical portions 16 and 17, the device in accordance with the invention is able to perform without any adjustment the closing of the side flaps of both wide and narrow boxes.

Figure 12:
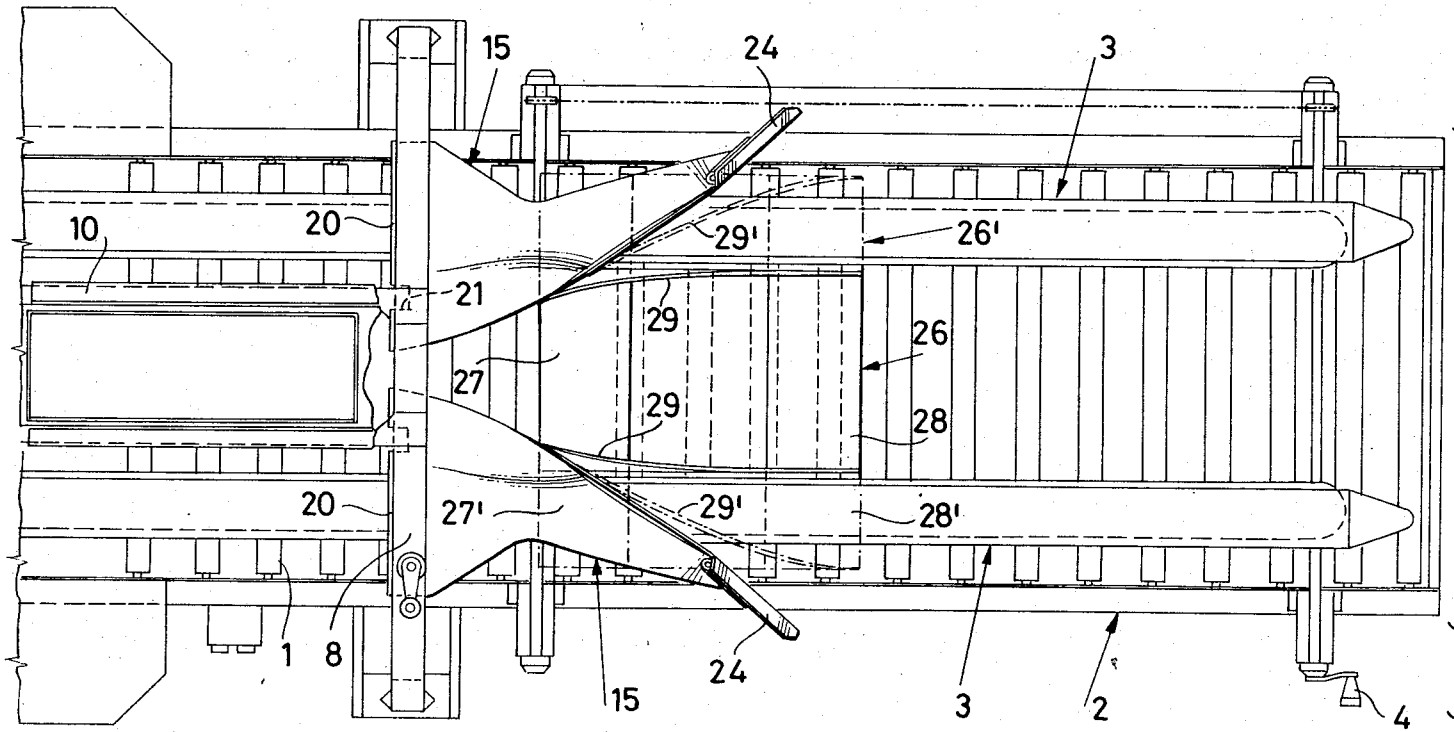
FIGS. 12 and 13 shows views of machines similar to those shown in FIGS. 2 and 3 in combination with boxes of greater and lesser width indicated respectively in unbroken and broken lines.
Figure 13:
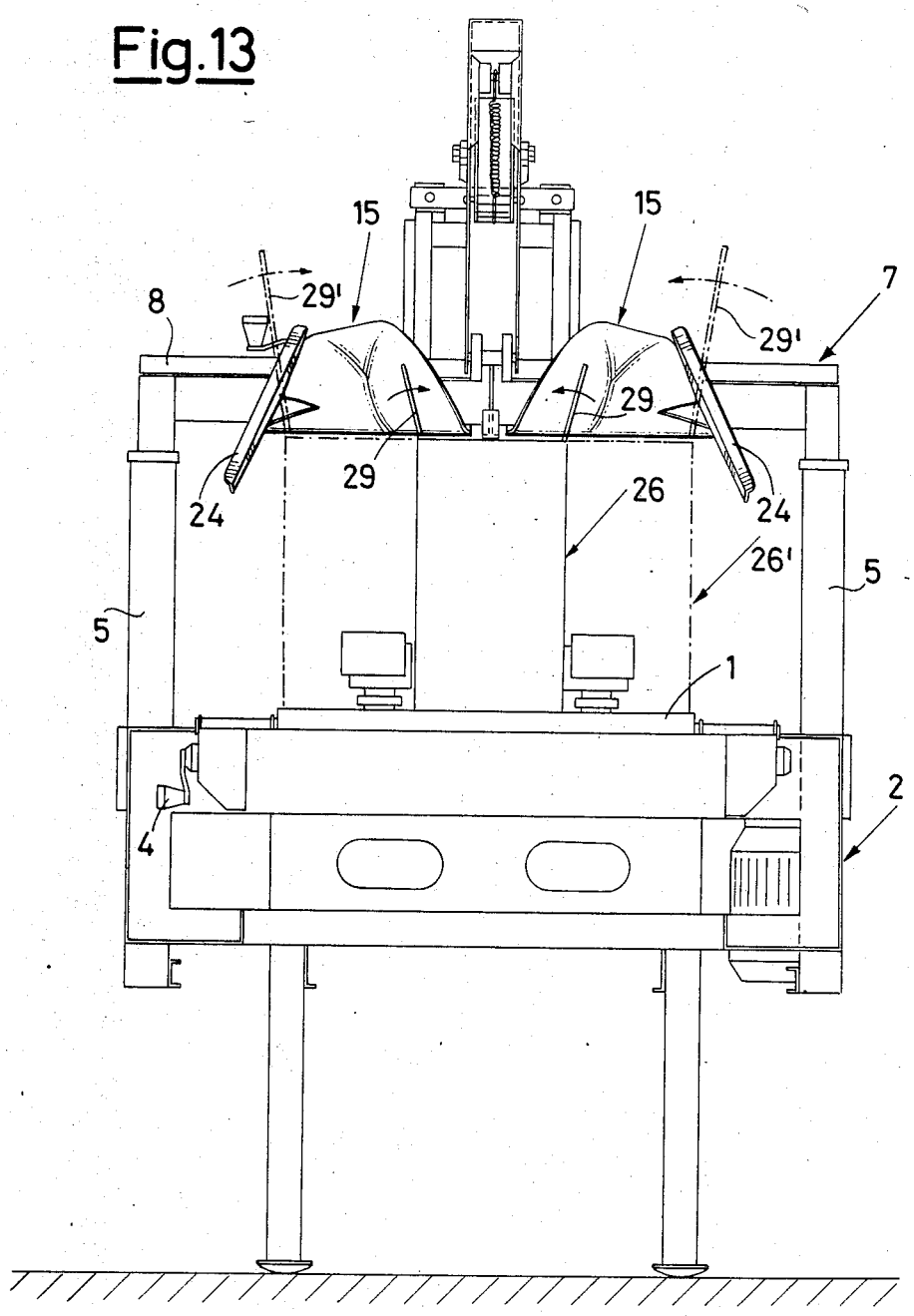

This can be seen in FIGS. 12 and 13 where a narrower box 26 with end flaps 27 and 28 already folded into the closed position and side flaps 29 in an erect position and being folded is shown in a continuous line and a similar narrower box 26' with side flaps 29' in a similar condition is illustrated in broken lines.

As can be seen in FIGS. 12 and 13, the side flaps 29 of the box 26, closer together and lower due to the effect of the lesser width of the box, engage the innermost helical portions 17 of the two guides 15 to be progressively folded thereby to the horizontal closing portion. The side flaps 29' of the box 26' which are further apart and higher due to the effect of the greater width of the box 26' engage the outermost helical portions 16 (starting from the reinforcements 24) to be progressively folded thereby to the horizontal closing position.

Given the flanking and longitudinally offset condition of the helical portions 16 and 17, there can be no box whose side flaps do not engage one or the other of said portions 16, 17 and thus undergo folding back for closing. If the box 26 is narrow the innermost portion 17 provides therefor, if the box 26' is wide the outermost portion 16 provides therefor, and in all cases the final position of the side flaps 29' of the box 26' is the closing position.

The only problem could arise in the case of a box 26' with widely opened side flaps 29' such that they become entangled with the helical guides is without being conveyed thereby to the closing position. To obviate this possible shortcoming, there is provided the possibility of adding to the illustrated machine suitable devices for the initial arrangement of the side flaps 29' in the erect position such as those described in Italian patent application no. 20150 A/78 dated 22 Feb. 1978 in the name of this applicant.

I claim:

1. Device for closing top side folding flaps of boxes of different widths from an erect open position comprising:

a pair of converging symmetrical guides characterized in that each of said guides includes two integral helical portions, one outermost and the other innermost, longitudinally offset in relation to each other, which portions develop backwardly and inwardly from basically parallel oblique inlet ends to coplanar horizontal outlet ends in such a manner that the top side folding flaps of wider boxes are engaged first by the outermost helical portions and the top side folding flaps of narrower boxes are engaged first by the innermost helical portions to progressively fold said flaps down to a horizontal closing position without the necessity of any distance adjustment of the pair of converging symmetrical guides.

2. Device in accordance with claim 1 characterized in that said parallel oblique inlet end of the outermost helical portion is fitted with a reinforcing section.

3. Device for closing the top side flaps of a box having folding flaps comprising a pair of converging symmetrical guides characterized in that each of said guides comprises two integral helical portions, one outermost and the other innermost, longitudinally offset in relation to each other, which develop from basically parallel oblique inlet ends to coplanar horizontal outlet ends in such a manner as to be engageable by the erect side flaps of wider or narrower boxes respectively to progressively fold back said flaps to the horizontal closing position; and characterized further in that said helical portions are arranged laterally adjacent to each other and are attached to each other along a common border line.

4. Device in accordance with claim 3 characterized in that each symmetrical guide includes another connecting portion between the parallel oblique inlet end of the two helical portions.

5. Device in accordance with claim 3 characterized in that said coplanar horizontal outlet end of the two helical portions are aligned transversally with each other.

* * * * *